United States Patent [19]

Gugelmeyer

[11] Patent Number: 5,049,095

[45] Date of Patent: Sep. 17, 1991

[54] AUTOMOTIVE FUSE SOCKET AND TERMINALS THEREFOR

[75] Inventor: Robert J. Gugelmeyer, Aurora, Ill.

[73] Assignee: Molex Incorporated, Lisle, Ill.

[21] Appl. No.: 532,771

[22] Filed: Jun. 4, 1990

[51] Int. Cl.[5] ..... H01R 11/22

[52] U.S. Cl. ..... 439/856; 439/839; 439/621; 439/830

[58] Field of Search ..... 439/851–857, 439/860, 861, 862, 830, 833, 845, 849, 850, 621, 622, 839

[56] References Cited

U.S. PATENT DOCUMENTS

| | | | |
|---|---|---|---|
| 3,133,780 | 5/1964 | Dean | 439/857 |
| 4,460,239 | 7/1984 | Inoue | 439/857 |
| 4,560,227 | 12/1985 | Bukala | 439/621 |
| 4,900,271 | 2/1990 | Colleran et al. | 439/856 |
| 4,907,990 | 3/1990 | Bertho et al. | 439/856 |

*Primary Examiner*—David L. Pirlot

*Attorney, Agent, or Firm*—Louis A. Hecht; Stephen Z. Weiss; A. A. Tirva

[57] ABSTRACT

A fuse socket is provided with a plastic housing having a fuse cavity for receiving an automotive fuse. The housing includes a pair of terminal receiving cavities for receiving the blades of the fuse. Blade receiving terminals are mounted in the respective terminal receiving cavities of the housing. Each blade receiving terminal includes a pair of opposed contact beams extending from a base and converging toward one another. Contact surfaces are defined at the locations of minimum distance between the contact beams. The terminal further includes a generally U-shaped assist structure having a bight generally adjacent the base of the terminal and having a pair of arms extending from the bight and being unitarily connected to locations on the contact beams remote from the base. Areas on the contact beams between the mating end and the base of the terminal are separated from the assist structure. Thus each contact beam will undergo deflection about a first axis at the connection of the contact beam to the base and a second axis at the connection of the contact beam to the assist structure. The contact surfaces are non-parallel in an unbiased condition of the terminal such that the contact surfaces deflect into parallel alignment upon insertion of the planar fuse blade therebetween.

14 Claims, 4 Drawing Sheets

AUTOMOTIVE FUSE SOCKET AND TERMINALS THEREFOR

BACKGROUND OF THE INVENTION

Fuses incorporated into the electronic circuitry of automotive vehicles comprise a pair of coplanar blade terminals that extend from a nonconductive fuse housing. Portions of the blade terminals disposed within the fuse housing are electrically connected to one another by a fuse wire that enables a circuit to be completed across the planar blade terminals. The fuse wire, however, is designed to break when subjected to current levels in excess of a pre-established maximum. The breaking of the fuse wire will break the circuit into which the fuse is incorporated, thereby preventing the high current levels from damaging the essential and/or expensive electrical components incorporated into the particular circuit of the vehicle's electrical system.

The planar blades of the automotive fuse are mated to a pair of terminals in a fuse socket. The terminals of the fuse socket include contact areas disposed adjacent to a fuse cavity in the socket housing. Thus the planar blade terminals of a fuse inserted into the fuse cavity will be electrically contacted by the terminals of the socket. The fuse socket or fuse block typically will be mounted to a circuit board having an array of circuits printed or otherwise disposed thereon. The fuse engaging terminals of the socket may thus include solder tails or other such electrical connection means for electrical connection to the circuits on the board.

It is essential that a high quality electrical connection to a fuse be maintained during all ranges of temperature, vibration and shock to which a vehicle is subjected. This high quality electrical connection may be achieved by providing high normal contact forces between the blade terminals of the automotive fuse and the terminals of the socket into which the automotive fuse is inserted. A high quality electrical connection also can be achieved by providing a large contact area between the respective terminals of the fuse and the socket.

Each terminal of a typical prior art automotive fuse socket includes a rear longitudinal end defining means for mounting to a circuit board, an intermediate portion for secure engagement in the fuse socket housing and a mating end for engaging a planar blade terminal of a fuse. The mating end of the typical prior art automotive fuse terminal is defined by a pair of cantilevered leaf-spring contact beams which are formed to converge toward one another and define contact surfaces at a minimum dimensioned gap therebetween. The contact surfaces of the prior art terminal will be substantially parallel to one another and will define a spacing that is less than the thickness of the fuse blade. Thus, the cantilevered contact beams will deflect symmetrically about parallel axes upon insertion of the fuse into the socket. The resiliency of the metal from which the prior art terminal is formed will cause the deflected cantilevered contact beams to exert contact forces against the planar fuse blade.

Although the prior art blade engaging terminals of this type have performed fairly well, it is desirable to provide higher contact forces for achieving better electrical connection during all ranges of shock, vibration and temperature to which an automotive vehicle is subjected. More particularly, it is difficult to design the prior art cantilevered leaf-spring contact beams to achieve higher contact forces without substantially increasing the size of the terminal. Larger terminals typically require more metal, and therefor are more costly. Additionally, the continuing trend toward miniaturization substantially prevents the use of larger terminals.

An extremely desirable automotive fuse connector is shown in U.S. Pat. No. 4,943,248 to Colleran et al. which is assigned to the Assignee of the subject application. U.S. Pat. application Ser. No. 4,943,248 shows and efficient fuse terminal that is stamped and formed to have contact surfaces defined by edge regions of the metal. With this construction, the contact beams will deflect about axes extending orthogonal to the plane of the metal, and will thereby generate very high normal contact forces for positively retaining the fuse during extreme conditions of vibration and shock. Despite the many advantages of the terminal shown in U.S. Pat. No. 4,943,248 , it is desirable to provide an automotive fuse engaging terminal that will provide a large contact area while still achieving high contact forces.

The recent prior art includes unitarily formed pin engaging terminals having a pair of opposed deflectable contact beams extending from a base and having a deflectable assist structure extending between portions of the contact beams remote from the base. The assist structure of these prior art pin engaging terminals may be generally U-shaped or generally in the shape of a tuning fork. Examples of such terminals are shown in U.S. Pat. No. 4,907,990 to D. Bertho et al. and U.S. Pat. application No. 4,900,271 to S. A. Colleran et al., the disclosures of which are incorporated herein by reference. The insertion of a pin into these prior art terminals will generate deflection of both the contact beams and the assist structure, such that the assist structure contributes to the contact forces exerted by the beams.

Co-pending Pat. application Ser. No. 441,674 now U.S. Pat. No. 4,968,270 was filed by Stephan Colleran and Robert Gugelmeyer and is assigned to the Assignee of the subject application. This co-pending application is directed to a socket for receiving a low wattage bulb intended for use in an automotive instrument panel. Bulbs of this type include a pair of thin deflectable leads which must be engaged by the terminals in the socket. The socket shown in this co-pending application includes terminals that employ the above described tuning fork assist structure. However, the contact beams of the terminals in this bulb socket are concavely arcuate from side to side to efficiently capture and align the leads of the bulb with the contact beams of the terminal in the bulb socket. The tuning fork assist structure contributes to the contact forces exerted against the leads of the bulb. The disclosure of this co-pending application also is incorporated herein by reference.

An entirely different terminal for engaging a pin, as opposed to a blade, is shown in U.S. Pat. No. 4,772,234 which issued to Cooper on Sept. 20, 1988. The terminal shown in U.S. Pat. No. 4,772,234 includes a generally box-shaped mating end that is intended to undergo a complex twisting upon insertion of a generally square pin. This twisting of the initially box-shaped mating end will cause the terminal to achieve small points of contact with the corners of a square pin inserted therein.

In view of the above described prior art, it is an object of the subject invention to provide an automotive fuse connector for achieving high quality electrical connection to the planar blade terminals of an automotive fuse.

It is another object of the subject invention to provide electrical terminals for use with planar blade terminals, such as the planar blade terminals of an automotive fuse.

It is a further object of the subject invention to provide blade receiving terminals that provide a large contact surface and high normal contact forces.

An additional object of the subject invention is to provide terminals having opposed non-parallel contact surfaces that deflect into parallel alignment with one another upon insertion of a blade terminal therebetween.

SUMMARY OF THE INVENTION

The subject invention is directed to an automotive fuse socket and to the electrically conductive terminals that may be mounted in the socket. The fuse socket comprises a housing that may be unitarily molded from a non-conductive material. The housing includes a lower face that may be mountable to a circuit board, panel or the like. An opposed upper face of the housing defines the mating face, and is characterized by at least one fuse cavity which extends to a location between the upper and lower faces of the housing. The fuse cavity is dimensioned to receive at least a portion of the housing of the automotive fuse. The housing of the fuse socket may further be characterized by a pair of terminal receiving cavities extending from the base of the fuse cavity to the lower face of the socket housing. The terminal receiving cavities are dimensioned and disposed to receive the respective planar blade terminals of the automotive fuse. Thus, the planar blade terminals of an automotive fuse may be inserted into the terminal receiving cavities of the housing as a portion of the fuse housing is being received in the fuse cavity of the socket housing. In many embodiments, the socket housing will be provided with a plurality of fuse cavities for receiving the housings of a corresponding plurality of automotive fuses. Each such fuse cavity may further be characterized by a pair of the above described terminal receiving cavities for receiving the blade terminals of a corresponding plurality of an automotive fuses.

The fuse socket of the subject invention further comprises a blade engaging terminal mounted in each terminal receiving cavity. Each blade engaging terminal is stamped and formed from a unitary piece of metallic material and includes a generally centrally disposed base for locking engagement of the terminal in the housing of the socket. A board mounting portion extends from the central portion for electrical connection to a conductive region on the circuit board to which the fuse socket is mounted. The board mounting portion of the terminal may define a solder tail dimensioned to extend through a hole in a circuit board for soldered electrical connection to a conductive region on the circuit board. The centrally disposed base of each terminal is characterized by locking means for locked engagement with corresponding structure in the terminal receiving cavity of the socket housing. For example, the base of each terminal may be characterized by one or more locking tangs which deflect during insertion into the socket housing, but which resiliently return to an undeflected condition upon complete insertion to lockingly engage a shoulder or other such locking structure on the housing. The centrally disposed base may be generally C-shaped with a bight wall and a pair of opposed arms extending from the bight wall. The C-shaped structure may be dimensioned to closely conform to the shape of the terminal receiving cavity in the socket housing.

The terminal of the subject invention further includes a mating portion for mating with a planar blade terminal of an automotive fuse. The mating portion is characterized by a pair of generally opposed contact beams extending from the base of the terminal. More particularly, the contact beams may extend from the respective arms on the C-shaped base of the terminal. The contact beams converge toward one another at further distances from the base, but diverge away from one another at the ends thereof furthest from the base to define a mating end into which the planar blade terminal of an automotive fuse may be inserted.

The terminal of the subject invention further includes an assist structure unitarily extending between and connecting the contact beams of the terminal. More particularly, the assist structure is of generally U-shape and includes opposed arms extending from ends of the contact beams remote from the base of the terminal. The arms of the assist structure are connected to one another at a bight portion which is disposed generally in proximity to the base of the terminal. Thus, the arms of the U-shaped tuning fork assist structure extend from mating ends of the contact beams back toward the base. The bight portion of the tuning fork assist structure may be unitarily connected to the base at define a root portion thereof. Thus, the root may connect the bight portion of the U-shaped tuning fork assist structure to the bight wall of the C-shaped base.

The terminal of the subject fuse socket bears structural and functional similarities to the tuning fork assist terminals described in the above referenced copending applications assigned to the Assignee of the subject invention. As described in those related applications and patents, the assist structure of the terminal contributes significantly to the contact forces that can be generated by the terminal. More particularly, the insertion of a planar fuse blade into the terminal of the subject fuse connector will cause the contact beams to deflect about their connection to the base, and will further cause the arms of the tuning fork assist structure to deflect about the bight portion. The resiliency of the metal from which the subject terminal is formed causes the arms of the assist structure to be biased back toward one another thereby contributing to the contact forces generated by the terminal. This function of the assist structure was described in the above referenced applications which were directed primarily to pin receiving terminals.

As noted above, good electrical connection to a planar blade terminal can further be assured by providing a large contact area in addition to providing high contact forces. The above described prior art tuning fork assist terminals provide exceptionally high quality electrical connection to pin terminals. However, the tuning fork assist structure results in a secondary axis of deflection for the contact beam. More particularly, each contact beam will deflect about a primary axis extending substantially orthogonal to the length of the contact beam and lying substantially in the plane of the arm of the C-shaped base from which the contact beam extends. In addition to this primary deflection, however, each contact beam will undergo a secondary deflection about the connection of the mating end of the contact beam to the assist structure. This secondary axis of deflection may be substantially orthogonal to the primary axis of deflection. With the prior art tuning fork assist terminal, the secondary deflection generated by the connection of the contact beam to the tuning fork assist structure could reduce the contact area to a wide planar terminal, such as the planar blade terminal of an automotive fuse.

To offset this characteristic of the above described prior art tuning fork assist terminals and to maximize the contact area, the terminal of the subject invention is formed such that the contact surfaces of the contact beams are non-parallel in the unbiased condition of the contact beams. More particularly, the contact surfaces converge toward one another at further distances from the assist structure. This convergence of the contact surfaces may exist even though the arms of the C-shaped base of the terminal may be generally parallel and even though the mating ends of the contact beams remote from the base may be parallel. With this construction, the contact surfaces will be substantially parallel and in face-to-face contact with the surfaces of the planar blade terminal after undergoing the secondary deflections generated by insertion of the fuse into the socket of the subject invention. Thus, this terminal configuration maximizes the contact area against the planar blade terminals while simultaneously achieving the high normal contact forces enabled by the tuning fork assist structure.

DETAILED DESCRIPTION OF THE PREFERRED EMBODIMENT

Figure 1:
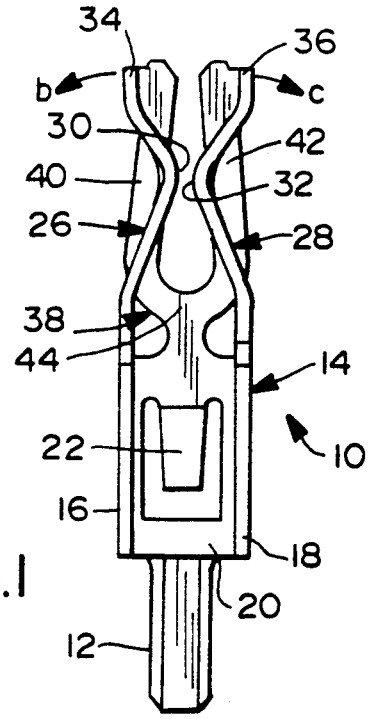
FIG. 1 is a front elevational view of a terminal in accordance with subject invention.
Figure 2:
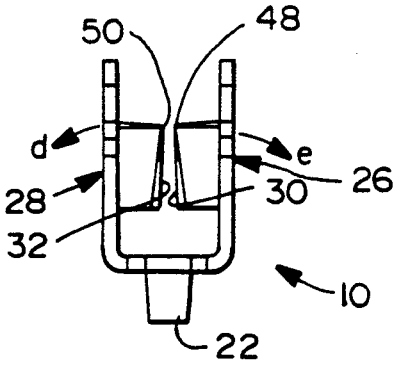
FIG. 2 is a top plan view of the terminal shown in FIG. 1.
Figure 3:
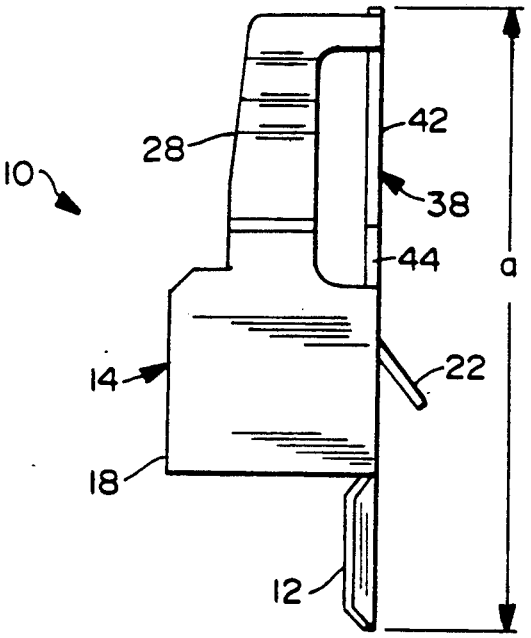
FIG. 3 is a side elevational view of the terminal.

The terminal for use in the fuse socket of the subject invention is identified generally by the numeral 10 in FIGS. 1–4. The terminal 10 is stamped and formed from a unitary piece of metal material such as a phosphor, bronze alloy approximately 0.30 mm thick. The terminal 10 is a generally elongate structure defining an overall length "a" of approximately 15 mm. A solder tail 12 defines one longitudinal end of the terminal 10, and is the portion of the terminal 10 that will be electrically connected to conductive regions on a circuit board (not shown). The solder tail 12 is formed to define a generally arcuate cross-sectional configuration for added rigidity and to prevent excess deformation during mounting of the terminal to a hole in the circuit board.

A base 14 is adjacent the solder tail 12 and defines an intermediate portion of the terminal 10 which will be lockingly engaged in the housing of the fuse socket as explained further herein. The base 14 defines a generally C-shaped structure having a pair of opposed parallel first and second arms 16 and 18 and a bight wall 20 extending orthogonally therebetween. The bight wall 20 is stamped to define a locking tang 22 which extends generally toward the solder tail 12, but at an acute angle from the bight wall 20. The locking tang 22 will deflect during insertion of the terminal 10 into a fuse socket housing as explained below, and will then resiliently return toward an undeflected alignment for lockingly engaging appropriate structure on the housing. As shown most clearly in FIG. 3, the corners 17 and 19 of arms 16 and 18 remote from the solder tail 12 and remote from the bight wall 20 is chamfered to facilitate the upward insertion of the terminal 10 into the fuse socket housing as explained below.

The terminal 10 further includes first and second contact beams 26 and 28 which extend respectively from the first and second arms 16 and 18 of the base 14. The contact beams 26 and 28 converge toward one another at further distances from the base 14 to first and second contact surfaces 30 and 32 respectively which define the minimum distance between the contact beams 26 and 28. The first and second contact beams 26 and 28 then diverge away from one another to define first and second mating ends 34 and 36. After inserting of the fuse, the mating ends 34 and 36 on the contact beams 26 and 28 respectively are generally parallel to one another and spaced apart a distance substantially corresponding to the distance between the arms 16 and 18 of the base 14.

Figure 4:
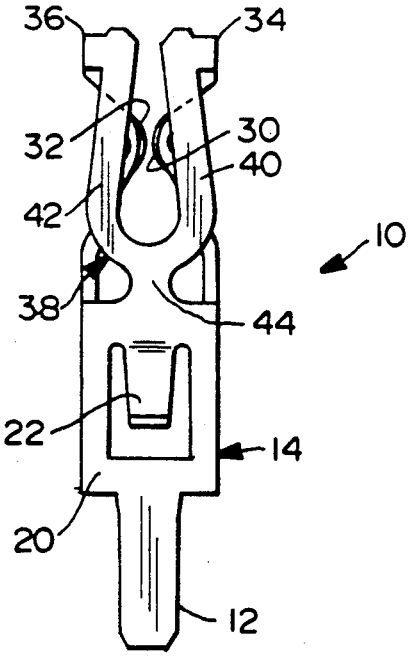
FIG. 4 is a rear elevational view of the terminal.
Figure 5:
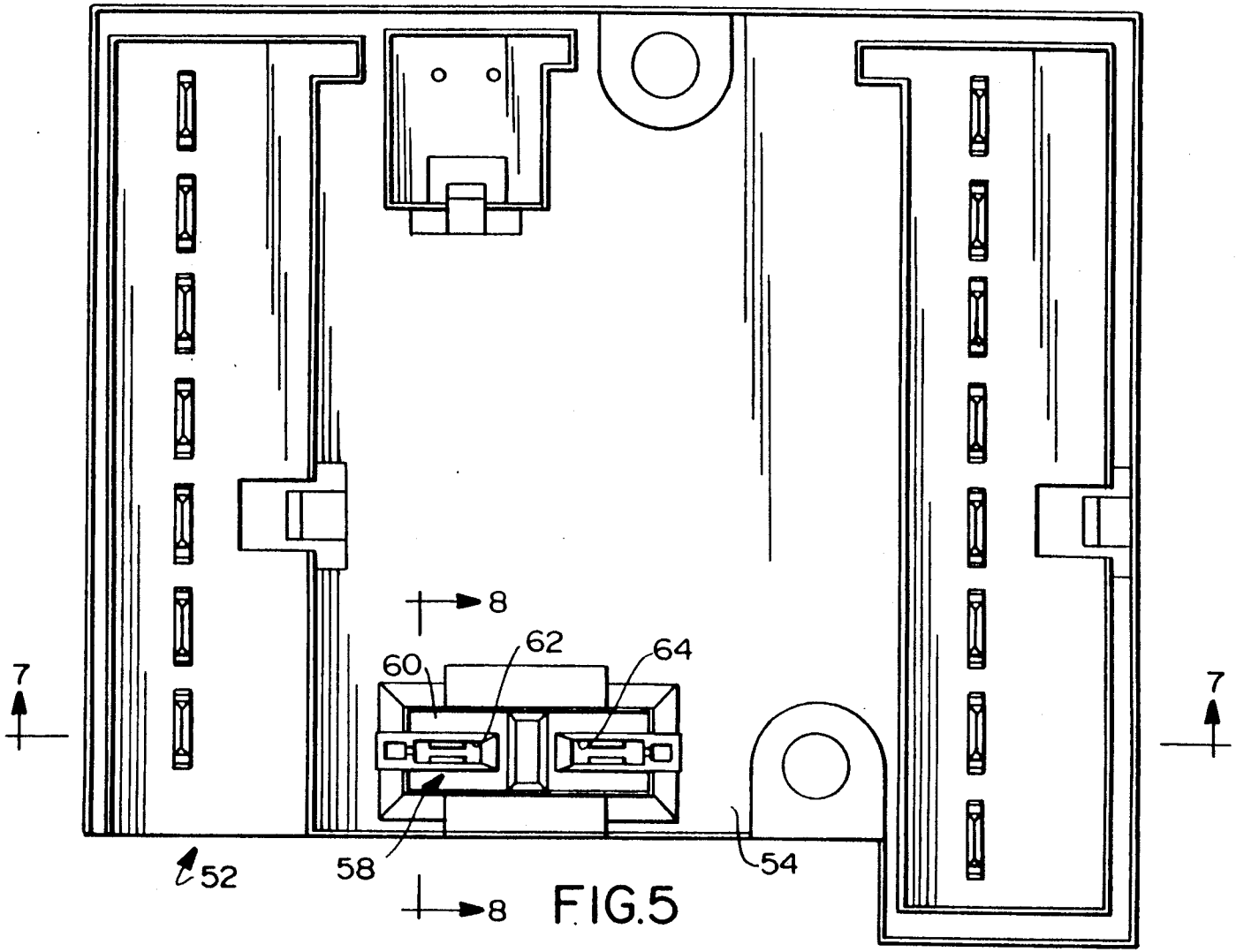
FIG. 5 is a top plan view of the fuse socket employing the terminal shown in FIGS. 1–4.
Figure 6:
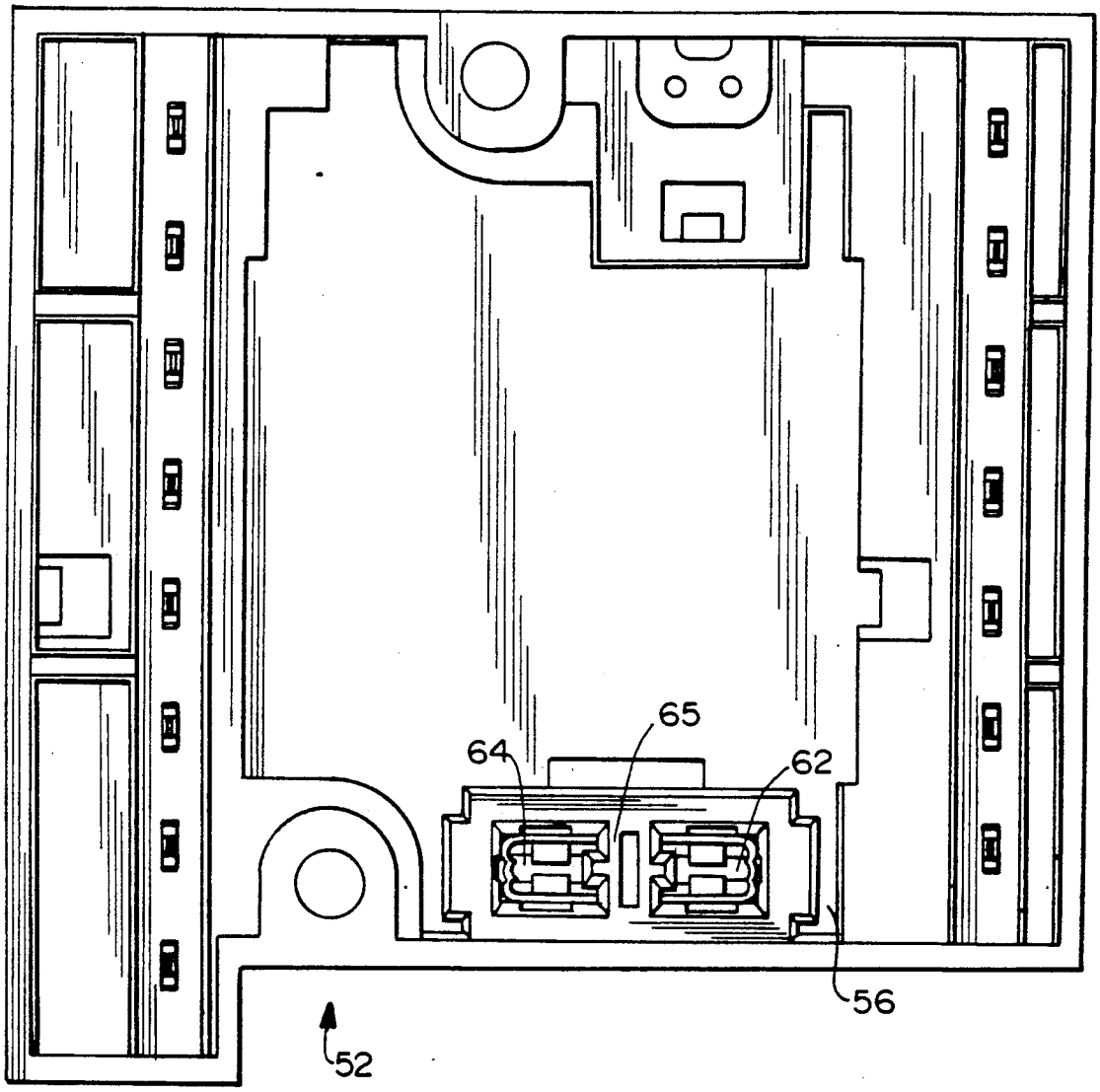
FIG. 6 is a bottom plan view of the fuse socket.

The terminal 10 further includes an assist structure identified generally by the numeral 38 in FIG. 4. The assist structure 38 is of generally tuning fork configuration and includes first and second arms 40 and 42 which are unitarily connected respectively to the first and second mating ends 34 and 36 of the corresponding first and second contact beams 26 and 28. The arms 40 and 42 of the assist structure 38 extend from the contact beams 26 and 28 back toward the base 14 of the terminal. The assist structure 38 further comprises a bight portion 44 which is connected to and unitarily extends between the respective arms 40 and 42 of the assist structure 38 generally adjacent the base 14 of the terminal 10. Additionally, the bight portion 44 of the assist structure 38 is unitarily connected to the bight wall 20 of the base 14 at a root 46 extending therebetween. As shown most clearly in FIG. 2, the entire assist structure 38 and the bight wall 20 of the base 14 lie substantially in a common plane which extends generally orthogonal to the arms 16 and 18 of the base 14 and to the mating ends 34 and 36 of the contact beams 26 and 28 respectively. As with above described prior art terminals, the assist structure 38 contributes substantially to the contact forces that can be generated by the contact beams 26 and 28 against a planar blade terminal inserted therein. In particular, any deflection of the contact beams 26 and 28 in the directions indicated by arrows "b" and "c" will cause a corresponding deflection of the arms 40 and 42 of the U-shaped assist structure 38. The resiliency of the U-shaped assist structure 38 will cause the arms 40 and 42 thereof to be urged back toward one another with corresponding increases in the contact forces exerted by the beams 26 and 28.

The unitary connection between the arms 40 and 42 of the U-shaped assist structure 38 and the mating ends 34 and 36 of the contact beams 26 and 28 define additional pivot locations about which the contact beams 26 and 28 will deflect. More particularly, upon insertion of the planar fuse blade into the mating end of the terminal 10, the contact beams 26 and 28 will deflect in directions "b" and "c" about primary axes extending through the parallel arms 16 and 18 of the base 14, and will further deflect in directions "d" and "e" about secondary axes extending through the respective connections of the contact beams 26 and 28 to the U-shaped assist structure 38. These secondary axes of deflection of the contact beams 26 and 28 will be substantially orthogonal to the first axes of deflection. Locations on either contact beam 26 and 28 that are further from an axis of deflection will move through a greater arc than locations closer to the axis of deflection. It follows, therefore, that locations on the contact surfaces 30 and 32 remote from the U-shaped assist structure 38 will deflect greater amounts than locations that are closer to the U-shaped assist structure 38.

As explained above, important objects of the subject invention are to achieve high normal contact forces against a planar blade terminal and to achieve a large contact area therewith. However, the deflection of the contact beams 26 and 28 in directions "d" and "e" about the arms 40 and 42 of the assist structure 38 will cause locations on the contact surfaces 30 and 32 that are remote from the assist structure 38 to pull away from the planar blade terminal of the fuse. This characteristic would have the effect of achieving a very small point contact location at corners of the planar fuse blade closest to the assist structure 38. To avoid this small contact area, the terminal of the subject invention is formed such that the contact surfaces 30 and 32 are not parallel to one another. Specifically, locations 48 and 50 on the contact surfaces 30 and 32 which are remote from the assist structure 38 define a minimum distance between the contact surfaces 30 and 32. As the contact surfaces 30 and 32 rotate in directions indicated by arrows "d" and "e" in response to insertion forces, the contact surfaces 30 and 32 will deform into a substantially parallel alignment that will achieve a large surface contact area with planar surfaces of the fuse blade, while simultaneously achieving the very high contact forces enabled by the assist structure 38. This non-parallel alignment of the contact surfaces 30 and 32 is achieved without urging the base 14 out of its rectangular configuration, and without affecting the parallel alignment of the mating ends 34 and 36 of the contact beams 26 and 28.

The terminal 10 is mounted in a fuse socket housing 52 as illustrated most clearly in FIGS. 5–8. The housing 52 is unitarily molded from a non-conductive material such as a glass filled polyester. The housing 52 defines an upper mating face 54 shown most clearly in FIG. 5 and a lower board mounting face 56 which is shown most clearly in FIG. 6. The socket housing is further characterized by at least one fuse cavity which extends into the upper face 54 of the housing 52 to a location intermediate the opposed upper and lower faces 54 and 56. The fuse cavity 58 is configured and dimensioned to receive at least a portion of the housing of an automotive fuse. The depth of fuse cavity 58 is defined by a base wall 60 which is disposed intermediate the opposed upper and lower faces 54 and 56 of the housing 52. The relative position of the base wall 60 with respect to the upper face 54 is such that a portion of a fuse housing inserted therein will extend above the upper face 54 to permit easy grasping with a thumb and forefinger or with an appropriate extraction tool. In an alternate embodiment, the housing is dimensioned to enable a fuse to be inserted a sufficient distance for the top of the fuse to be substantially flush with the upper face of the housing. This positioning of the fuse prevents inadvertent contact that could otherwise damage the fuse or the fragile terminals in the housing. However, it may still be necessary to periodically remove and replace fuses. To enable such removal, the housing is further provided with extraction notches disposed therein to be on opposite sides of the fuse. The extraction notches are dimensioned to receive gripping portions of an extraction tool. The extraction tool will grip opposed sides of the fuse to enable removal.

The housing 52 is further characterized by a pair of terminal receiving cavities 62 and 64 extending from the base 60 of the fuse cavity 58 to the lower face 56 of the housing 52. The terminal receiving cavities 62 and 64 are dimensioned and disposed to accept the planar blade terminals of an automotive fuse inserted into the fuse cavity. The terminal receiving cavities 62 and 64 also are dimensioned to lockingly receive a pair of the terminals 10 in opposed facing relationship to one another as explained herein. An interior support wall 65 separates the terminal receiving cavities 62 and 64. The interior support wall 65 insures that the blade terminals of the fuse are guided into the contact surfaces 30 and 32 of the terminal 10, and not into the assist structure 38.

Figure 7:
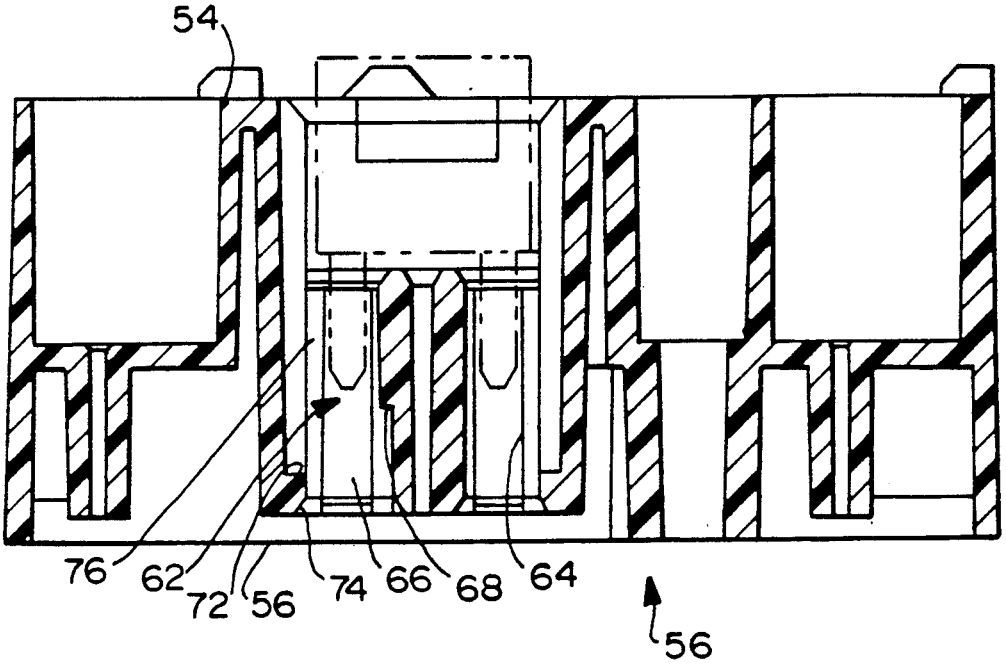
FIG. 7 is a cross-sectional view taken along line 7—7 in FIG. 5.
Figure 8:
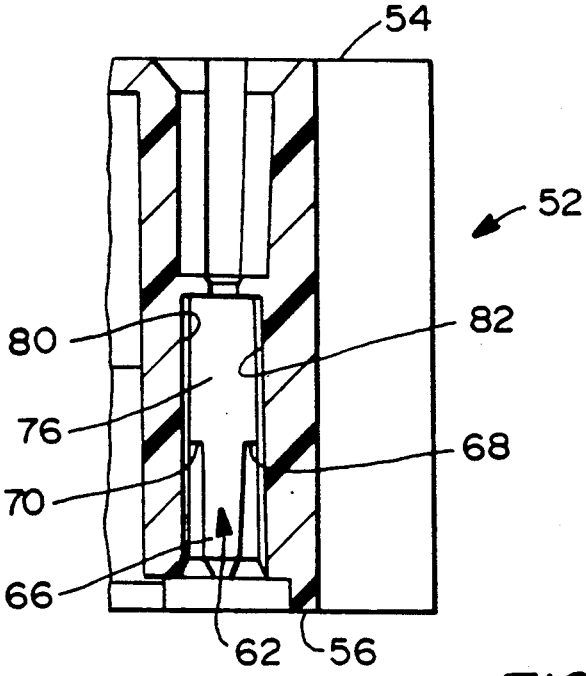
FIG. 8 is a cross-sectional view taken along line 8—8 in FIG. 5.

With reference to FIGS. 7 and 8, it will be noted that the terminal receiving cavities 62 and 64 are substantially identical to one another but are disposed in opposed facing alignment with one another. For simplicity of explanation, only the fuse receiving cavity 62 will be described in detail. However, it is understood that identical structure exists in the fuse receiving cavity 64.

With reference to FIG. 7, the fuse receiving cavity 62 includes a lower mounting portion 66 which is of generally rectangular cross-sectional configuration and dimension to receive the base 14 of the terminal 10. More particularly, the lower mounting portion 66 of the cavity 62 includes upper positioning shoulders 68 and 70 against which the upper corners 17 and 19 of the terminal 10 will engage to define the maximum range of upward movement of the terminal 10 into the cavity 62. The mounting portion 66 of the cavity 62 further includes a lower locking shoulder 72 for engaging the locking tang 22 of the terminal 10. More particularly, as the terminal 10 is inserted upwardly into the cavity 62, the locking tang 22 will resiliently deform upon contact with the lower ramped face 74 of the shoulder 72. However, at the point during the insertion when the upper corners 17 and 19 of the arms 16 and 18 engage the upper positioning shoulders 68 and 70, the locking tang 22 will have passed the locking shoulder 72. At this point during the insertion, the locking tang 22 will resiliently return to an undeflected condition to engage the lower locking shoulder 72 and prevent downward withdrawal of the terminal 10 in response to insertion forces generated by an automotive fuse. In this position, the solder tail 12 will extend below the lower face 56 of the housing 52 to enable subsequent electrical connection to a conductive region on a circuit board to which the housing 52 is mounted. The terminal 10 can be removed from the housing 52 if necessary. The removal is effected by inserting a straight shaft extraction tool into the terminal receiving cavity 62 from the upper face 54. The straight shaft extraction tool is aligned to contact and deflect the locking tang 22 on the terminal 10 into an alignment that is free of the locking shoulder 72 to enable the terminal 10 to be moved downwardly and out of the housing 52.

The terminal receiving cavity 62 further includes an upper mating portion 76 into which the contact beams 26 and 28 and the U-shaped tuning fork assist structure 38 extend. More particularly, the tuning fork assist structure will be disposed substantially adjacent the outer wall 78 of the mating portion 76 of the cavity 62. In this fully mounted condition, the non-parallel contact surfaces 30 and 32 of the contact beams 26 and 28 are formed inwardly to generally more central locations between the parallel front and rear walls 80 and 82 of the cavity 62.

Returning to FIG. 5, it will be noted that the tuning fork assist structure 38 of the respective terminals 10 are disposed at outer locations relative to the fuse cavity 58 and the terminal receiving cavities 62 and 64. With this orientation of the terminals 10, the portions 48 and 50 of the contact surfaces 30 and 32 of one terminal 10 are disposed near the corresponding converging portions of the other terminal. Upon insertion of the fuse blades into the terminal receiving cavities, the contact surfaces will deflect away from one another about primary axes that are parallel to one another and disposed in the arms 16 and 18 of the base 14 and will further deflect about secondary axes orthogonal to the primary axes and disposed at the connection of the contact beams 26 and 28 to the assist structure 38.

In summary, an automotive fuse socket is provided with terminals for achieving high normal contact forces against the planar blade terminals of an automotive fuse with a large contact area therebetween. Each terminal of the socket includes a generally C-shaped base from which a pair of opposed converging contact beams extend. A generally U-shaped assist structure is provided to increase the contact forces of the contact beams. The U-shaped assist structure includes a pair of arms connected to one another at a bight. The arms extend unitarily from locations on the contact beams remote from the base while the bight of the assist structure is connected to the base. Each contact beam will deflect about two orthogonal axes, namely a first axis at the location where the contact beam extends from the base and a second axis where the contact beam is connected to the assist structure. In their undeflected condition, the contact surfaces converge toward one another at locations further from the assist structure. Thus, the contact surfaces will deflect into parallel alignment as the planar automotive fuse blade is inserted therebetween to achieve a large area of contact therewith while simultaneously achieving high normal contact forces.

While the invention has been described with respect to a preferred embodiment, it is apparent that various changes can be made without departing from the scope of the invention as defined by the appended claims. For example, other means for locking the terminal to the housing may be provided. Similarly, in some embodiments the bights of the assist structure and the terminal base may not be connected. These and other changes will be apparent to the person skilled in this art after having read the subject disclosure.

I claim:

1. An electrically conductive terminal stamped and formed from a unitary piece of metallic material and comprising a generally C-shaped base having a bight wall and first and second opposed arms extending unitarily from the bight wall, first and second contact beams connected to and extending from the respective first and second arms of the base and defining mating ends at locations on the contact beams remote from the base, said contact beams converging toward one another to define contact surfaces across the width of the beams at locations of minimum distance therebetween, said terminal further comprising a generally U-shaped assist structure having a bight portion in proximity to the base of the terminal portion and first and second arms extending from the bight portion and connected unitarily with the mating ends of the respective first and second contact beams, said assist structure being separated from the contact beams at locations intermediate the mating ends and the base, wherein the improvement comprises:

the contact surfaces across the width of the first and second contact beams being non-parallel in an unbiased condition of the terminal and converging toward one another at locations thereon further from the assist structure, whereby upon insertion of a blade terminal between the contact beams, each contact beam deflects about a first axis at the connection of the contact beam to the base and about a second axis at the connection of the contact beam to the assist structure, the deflection of the contact beam about the assist structure urging the contact surfaces across the width of the first and second contact beams into parallel alignment with one another upon insertion of a planar blade terminal therebetween.

2. A terminal as in claim 1 wherein the bight portion of the assist structure is connected to the bight wall of the base.

3. A terminal as in claim 1 wherein the arms of the base are substantially parallel to one another.

4. A terminal as in claim 3 wherein the mating ends of the contact beams are substantially parallel to one another.

5. A terminal as in claim 4 wherein the arms of the base are substantially planar and wherein the mating end of each contact beam is substantially coplanar to the associated arm of the base.

6. A fuse socket for mating with an automotive fuse having a non-conductive fuse housing and a pair of coplanar blades terminals extending from the fuse housing, said fuse socket comprising:

a housing having an upper face and a lower face, a fuse cavity extending into the upper face, said fuse cavity being dimensioned to receive a portion of the fuse housing, a pair of terminal receiving cavities extending from the fuse cavity to the lower face of the housing, said terminal receiving cavities being dimensioned and disposed to receive the blade terminals of the fuse; and a pair of substantially identical blade receiving terminals engaged in the respective terminal receiving cavities, each said blade receiving terminal comprising a generally C-shaped base having a bight wall and first and second opposed arms, said base comprising means for locking engagement of the blade receiving terminal in the housing, first and second contact beams extending unitarily from the first and second arms to mating ends generally in proximity to the fuse cavity of the housing, said contact beams converging toward one another at locations intermediate the base of the terminal and the mating ends to define contact surfaces across the width of the contact beams at locations defining a minimum distance between said contact beams, an assist structure having a bight portion in proximity to the bight wall of the base and having first and second arms extending from the bight portion to the respective first and second contact beams at the mating ends thereof, said contact beams being separate from the assist structure, at locations intermediate the mating ends and the base of the terminal, the contact surfaces across the width of the contact beams converging toward one another at locations thereon further from the assist structure in an unbiased condition of the terminal, whereby the assist structure contributes to forces generated in response to deflection of the contact beams, and whereby the contact surfaces across the width of the contact beams deflect into parallel alignment with one another upon insertion of the planar fuse blade into the housing.

7. A socket as in claim 6 wherein the arms of the base are substantially parallel to one another.

8. A socket as in claim 7 wherein portions of the mating ends of the contact beams are substantially parallel to one another.

9. A socket as in claim 8 wherein the arms of the base are substantially planar, and wherein the mating end of each contact beam is substantially coplanar with the associated arm of the base.

10. A socket as in claim 6 wherein the assist structure and the bight wall of the base lie substantially in a common plane.

11. A socket as in claim 10 wherein the bight portion of the assist structure is unitarily connected to the bight wall of the base.

12. A socket as in claim 6, wherein upon insertion of a blade terminal between the contact beams, each contact beam deflects about a first axis at the connection of the contact beam to the base and about a second axis at the connection of the contact beam to the assist structure.

13. A socket as in claim 12, wherein said first and second axes are substantially orthogonal to each other.

14. A terminal as in claim 1, wherein said first and second axes are substantially orthogonal to each other.

* * * * *